US005583633A

United States Patent [19]

Matsumura et al.

[11] Patent Number: 5,583,633

[45] Date of Patent: Dec. 10, 1996

[54] DEVICE FOR DETECTING A DEFECT IN CHARCOAL TYPE FILTERS OF MANUFACTURED FILTER CIGARETTES

[75] Inventors: Takeshi Matsumura; Hidenori Muramoto; Mikio Komori, all of Tokyo, Japan

[73] Assignee: Japan Tobacco Inc., Tokyo, Japan

[21] Appl. No.: 341,867

[22] Filed: Nov. 15, 1994

[30] Foreign Application Priority Data

Nov. 16, 1993 [JP] Japan ..... 5-286655

[51] Int. Cl.[6] ..... G01N 21/00; G01B 11/00

[52] U.S. Cl. ..... 356/237; 356/394; 356/426; 250/559.4; 250/559.46; 131/905; 131/906; 131/907; 131/908

[58] Field of Search ..... 356/237, 394, 356/426; 250/559.4, 559.46; 359/507, 509; 131/905–909

[56] References Cited

U.S. PATENT DOCUMENTS

| | | | |
|---|---|---|---|
| 2,896,854 | 7/1959 | Noble et al. . | |
| 3,812,349 | 5/1974 | Gugliotta et al. | 356/237 |
| 3,818,223 | 6/1974 | Gibson et al. | 250/559.4 |
| 4,240,691 | 12/1980 | Holmqvist et al. | 359/509 |
| 4,639,592 | 1/1987 | Heitmann | 250/559.46 |
| 4,644,150 | 2/1987 | Kuga et al. | 356/237 |
| 4,836,689 | 6/1989 | O'Brien et al. | 359/509 |
| 4,976,544 | 12/1990 | Weri | 356/237 |
| 5,353,357 | 10/1994 | Longest, Jr. et al. | 356/237 |

FOREIGN PATENT DOCUMENTS

| | | | |
|---|---|---|---|
| 0338241 | 10/1989 | European Pat. Off. . | |
| 59-057142 | 4/1984 | Japan | 359/509 |
| 62-212505 | 9/1987 | Japan | 359/509 |
| 2176598 | 12/1986 | United Kingdom . | |
| 2193314 | 2/1988 | United Kingdom . | |

*Primary Examiner*—Frank Gonzalez
*Assistant Examiner*—Jason D. Eisenberg
*Attorney, Agent, or Firm*—Birch, Stewart, Kolasch & Birch, LLP

[57] ABSTRACT

A device for inspecting the filter end face of a filter cigarette is provided with an optical sensor having an aperture ring for emitting a measuring light toward the filter end face and receiving the light reflected from the filter end face and outputting a detection signal corresponding to the luminous energy of the reflected light, a hood for covering the aperture ring of the optical sensor, a plurality of injection holes for injecting compressed air into the hood, and a processing unit for determining whether the filter end face is normal or not in accordance with the detection signal output from the optical sensor.

13 Claims, 8 Drawing Sheets

DEVICE FOR DETECTING A DEFECT IN CHARCOAL TYPE FILTERS OF MANUFACTURED FILTER CIGARETTES

BACKGROUND OF THE INVENTION

1. Field of the Invention

This invention relates to an inspection device for detecting the quality of the filter end face of a filter cigarette as one of quality inspections.

2. Description of the Related Art

Various types of filters of filter cigarettes are known. One of the types of filters of filter cigarettes is a dual filter shown in FIG. 1. The dual filter has a charcoal filter member Fc containing charcoal particles and a white plain filter member Fp and these filter members Fc and Fp are arranged on the same axial line in order from the end of a cigarette C.

Therefore, the charcoal particles are not exposed to the filter end face and the filter end face can be kept white because the filter end face remote from the cigarette C is made of the plain filter member Fp Moreover, no charcoal particle enters the mouth of a smoker when he or she smokes.

The filter end face of the dual-filter-type filter cigarette must be inspected in its manufacturing process. As a result of the inspection, a defective filter cigarette to whose filter end face charcoal particles are exposed or through which charcoal particles are seen must be removed from the manufacturing line.

For example, an optical sensor can be used to inspect a filter end face. The optical sensor emits measuring light toward the filter end face of a filter cigarette and simultaneously receives the light reflected from the filter end face to output a detection signal corresponding to the luminous energy of the reflected light as a voltage signal. The level of the detection signal output from the optical sensor changes in accordance with the stage of the filter end face as shown by a solid line in FIG. 2.

More specifically, the defective state of a filter end face is classified into a completely-defective state and a semi-defective state. A completely-defective filter end face is defined as a filter end face made of the charcoal filter member Fc with no plain filter member as shown in FIG. 3. A semi-defective filter end face is defined as a filter end face with an insufficient length of the plain filter member Fp as shown in FIG. 4. At the semi-defective filter end face, charcoal particles in the charcoal filter member Fc are seen through the plain filter member Fp.

Therefore, in the case of a defective filter end face, the luminous energy of the reflected light returned to the optical sensor from the defective filter end face decreases compared with that of a normal filter end face, and the level of a detection signal of the optical sensor lowers as shown in FIG. 2. Moreover, when comparing a completely-defective filter end face with a semi-defective filter end face, the luminous energy of the reflected light returned to the optical sensor from the completely-defective filter end face, that is, the level of the detection signal of the optical sensor further lowers.

In FIG. 2, the expression "none" represents the level of a detection signal output from the optical sensor or the base level when no light is reflected from a filter end face, that is, when no filter cigarette to be inspected is present.

A filter cigarette with a defective filter end face must be excluded because it is a defective product. Therefore, the optical sensor is electrically connected to a comparing circuit and the comparing circuit receives a detection signal output from the optical sensor. The comparing circuit has a criterion for determining whether the filter end face of a manufactured filter cigarette is normal or not, and the level of the criterion is set between the level of the detection signal showing a normal filter end face and the level of the detection signal showing a semi-defective filter end face, as shown by the broken line in FIG. 2. Therefore, the comparing circuit compares the detection signal received from the optical sensor with the criterion and outputs an exclusion signal when the level of the detection signal does not exceed the criterion. A defective filter cigarette is excluded from a manufacturing line based on the exclusion signal.

The optical sensor of the type described above has an aperture for emitting measuring light to the filter end face of a filter cigarette to be inspected and receiving the light reflected from the filter end face. When dust paper and white dust of filter members produced during manufacturing of filter cigarettes enters the aperture and is deposited, the light reflected from the deposit of the dust is added to the light reflected from the filter end face to be inspected. Therefore, as shown by one dot chain line in FIG. 2, the level of the detection signal output from the optical sensor becomes higher than the level of the detection signal corresponding to the light reflected only from the filter end face shown by the solid line in FIG. 2.

The difference between the level of the detection signal showing a semi-defective filter end face and the criterion is small. Therefore, when the optical sensor receives the light reflected from the above-mentioned white deposit in addition to the light reflected from the semi-defective filter end face, the level of the detection signal of the optical sensor exceeds the criterion. In this case, the comparing circuit determines the defective filter cigarette as a normal filter cigarette, and thus a defective filter cigarette cannot accurately be excluded.

SUMMARY OF THE INVENTION

The object of the present invention is to provide an inspection device for accurately inspecting the filter end face of a manufactured filter cigarette in order to securely exclude defective products.

The above object is achieved by the inspection device of the present invention and the inspection device comprises: sensing means for measuring a state of the filter end face of a filter cigarette during transportation thereof, the sensing means including an aperture opened toward the filter end face of the filter cigarette and allowed the light reflected from the filter end face to receive therein, and outputting a detection signal corresponding to the luminous energy of the received reflected light; a hood protruding from the aperture for enclosing the aperture, which has a hood mouth located on the same axis as the aperture; blowing means for supplying compressed air into the hood and exhausting the supplied compressed air through the hood mouth; and determining for comparing the detection signal output from the sensing means with a criterion to determine the state of the filter end face based on the compared result.

According to the above inspection device, since the aperture of the sensing means is covered with the hood, the quantity of the above-mentioned white dust entering the aperture is decreased. The compressed air supplied into the hood is exhausted through the hood mouth, thereby preventing dust from entering the hood through the hood mouth.

Moreover, even if dust entering the hood is deposited in the hood, the deposited dust is effectively removed by the flow of the compressed air.

It is preferable for the hood mouth to have an inner diameter smaller than that of the aperture of the sensing means. With such structure, the amount of dust entering the hood is further decreased.

The blowing means includes a ring member arranged in the hood and having a diameter larger than the inner diameter of the hood mouth, an annular chamber receiving compressed air being defined between the ring member and the inner periphery of the hood, and a plurality of injection holes for injecting the compressed air stored in the annular chamber into the ring member. In this case, as the compressed air entering the ring member from the annular chamber through the injection holes flows to the inside of the ring member in its radial direction, it is possible to effectively decrease or prevent the deposition of dust in the hood.

The determining means includes shifting means for shifting the lowest output level of the detection signal output from the sensing means by a predetermined value. Accordingly, even if the detection signal output from the sensing means includes a component due to the light reflected from the dust deposited in the hood, the component is removed by shifting the lowest output level of the detection signal by a predetermined value.

Specifically, the shifting means includes a clamping circuit for receiving the detection signal output from the sensing means, and the clamping circuit outputs a second detection signal obtained by clamping the lowest output level of the detection signal to a fixed value. At this time, the above component is removed from the second detection signal of the clamping circuit.

The determining means preferably includes an amplifying circuit for outputting a third detection signal obtained by amplifying the second detection signal of the clamping circuit from the fixed level as a base level. The output level of the third detection signal clearly shows the state of a filter end face to be inspected.

Moreover, the determining means includes a comparing circuit for comparing the third detection signal with a criterion and outputting the compared result and the criterion is set with respect to the fixed level. Because the output level of the third detection signal shows the state of a filter end face as described above, it is possible to accurately determine whether the filter end face is normal or not by comparing the third detection signal with the criterion.

When a filter end face to be inspected is the filter end face of a dual filter or triple filter, the output level of the third detection signal includes a first level showing that the filter end face is normal, a second level showing that the filter end face is completely defective, and an intermediate level showing that the filter end face is semi-defective and lying between the first and second levels, and the criterion of the comparing circuit is set between the first and the intermediate levels. The comparing circuit outputs a normal signal when the third detection signal exceeds the criterion toward the first level side and outputs an abnormal signal when the third detection signal is between the criterion and the fixed level.

BRIEF DESCRIPTION OF THE DRAWINGS

The present invention will become more fully understood from the detailed description given herein below and the accompanying drawings which are given by way of illustrations only, and thus, are not limitative of the present invention, and wherein.

DETAILED DESCRIPTION OF THE PREFERRED EMBODIMENTS

Figure 5:
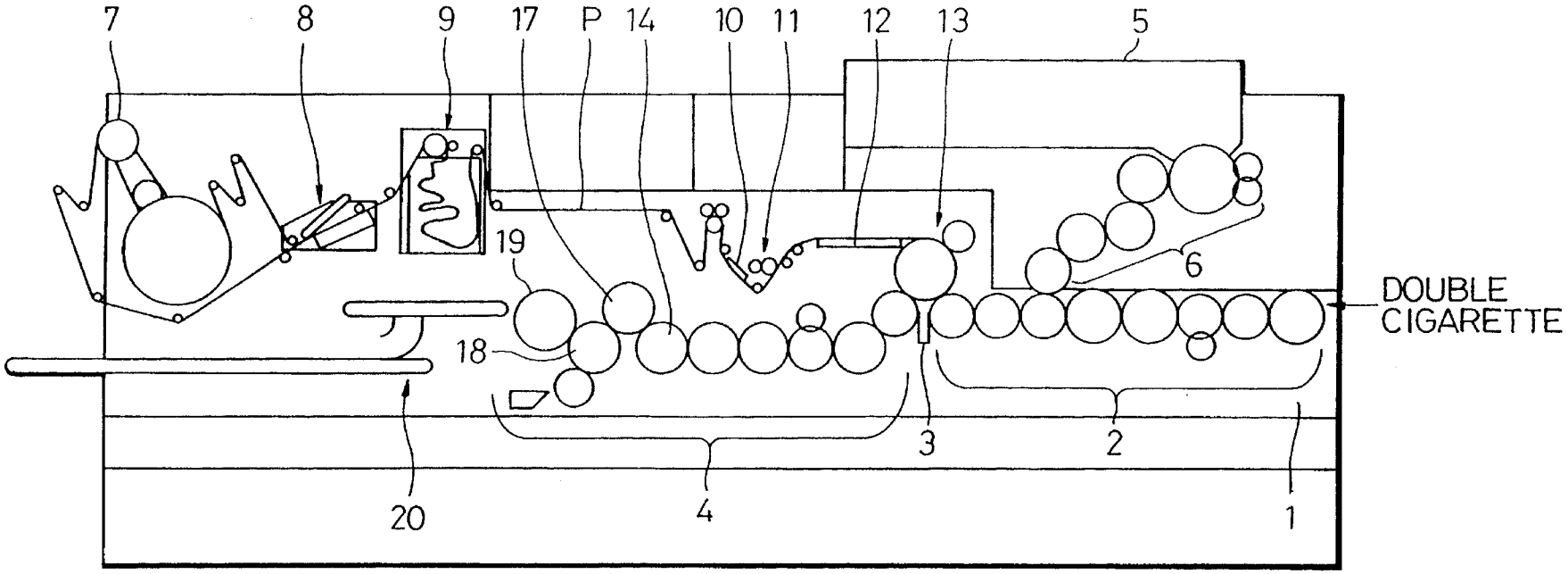
FIG. 5 is a schematic view showing a filter attachment for manufacturing filter cigarettes.

Referring to FIG. 5, a main frame 1 of a filter attachment is provided with a drum train 2 extending from the right end toward the left, a drum train 4 further extending leftward from the left end of the drum train 2 through a wrapping section 3, and a drum train 6 for connecting a hopper 5 housing a filter rod with the drum train 2.

Moreover, the wrapping section 3 is connected with a paper roll 7 through a supply line on which a connecting device 8, a reservoir 9, a preheater 10, a glue applicator 11, a postheater 12, and a cutter 13 are arranged in order from the paper roll side.

Figure 6:
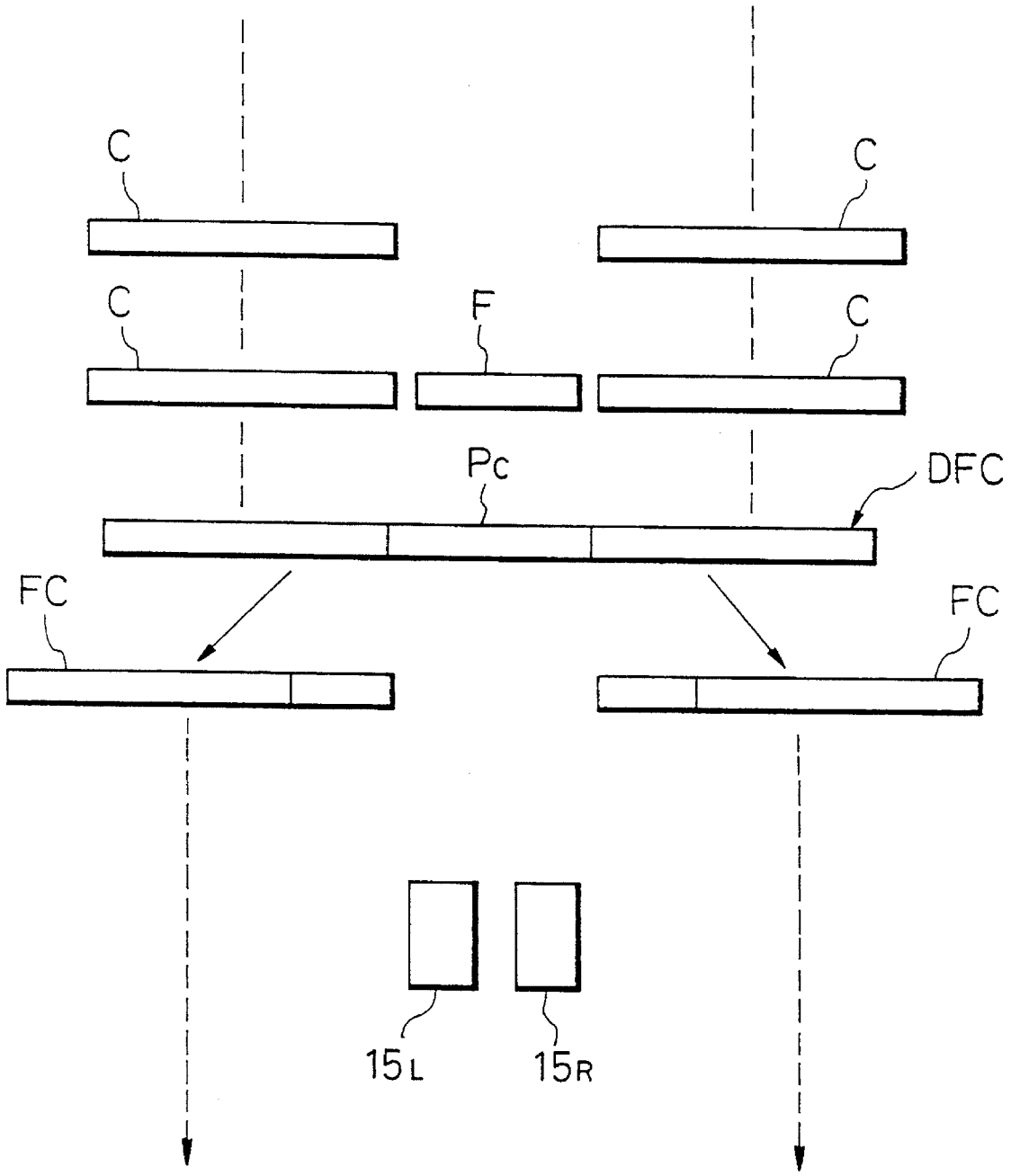
FIG. 6 is an illustration showing a procedure for manufacturing the filter cigarettes.

Manufacturing of filter cigarettes is briefly described below by referring to FIG. 6. A double cigarette supplied from a cigarette manufacturing machine (not shown) to the right end of the drum train 2 is transferred on the drum train 2 toward the wrapping section 3 and equally cut into a pair of cigarettes C while the double cigarette is transferred. Thereafter, the cigarettes C are separated from each other.

A filter rod taken out of the hopper 5 onto the drum train 6 is equally divided into a plurality of filter plugs F while it is transferred on the drum train 6. These filter plugs F are then positioned between every pair of cigarettes C on the drum train 2 one by one and transferred to the wrapping section 3 together with the cigarettes C. While the filter plug F and cigarettes C are transferred, the pair of cigarettes C are brought into contact with the both ends of the filter plug F. In this case, the filter plug F is a triple charcoal filter having a charcoal filter member arranged at the center thereof and a pair of charcoal filter members arranged at the both ends of the plain filter member.

Further, a paper web P drawn out of the paper roll 7 through the supply line is preheated by a preheater 10, applied with glue by the applicator 11, and heated by the postheater 12, and thereafter supplied to the cutter 13. The cutter 13 cuts the paper web P into pieces of paper Pc with a predetermined length and supplies these pieces of paper Pc to the wrapping section 3 one by one.

The wrapping section 3 receives a pair of cigarettes C, filter plug F, and the piece of paper Pc to form a double filter cigarette DFC by wrapping the piece of paper Pc and connecting the cigarettes and the filter plug each other.

Thereafter, the double filter cigarette DFC is supplied to the drum train 4 from the wrapping section 3 and transferred on the drum train 4. While the double filter cigarette DFC is transferred, it is cut at its center and thus a pair of filter cigarettes FC arranged on the same axis are obtained.

Figure 7:
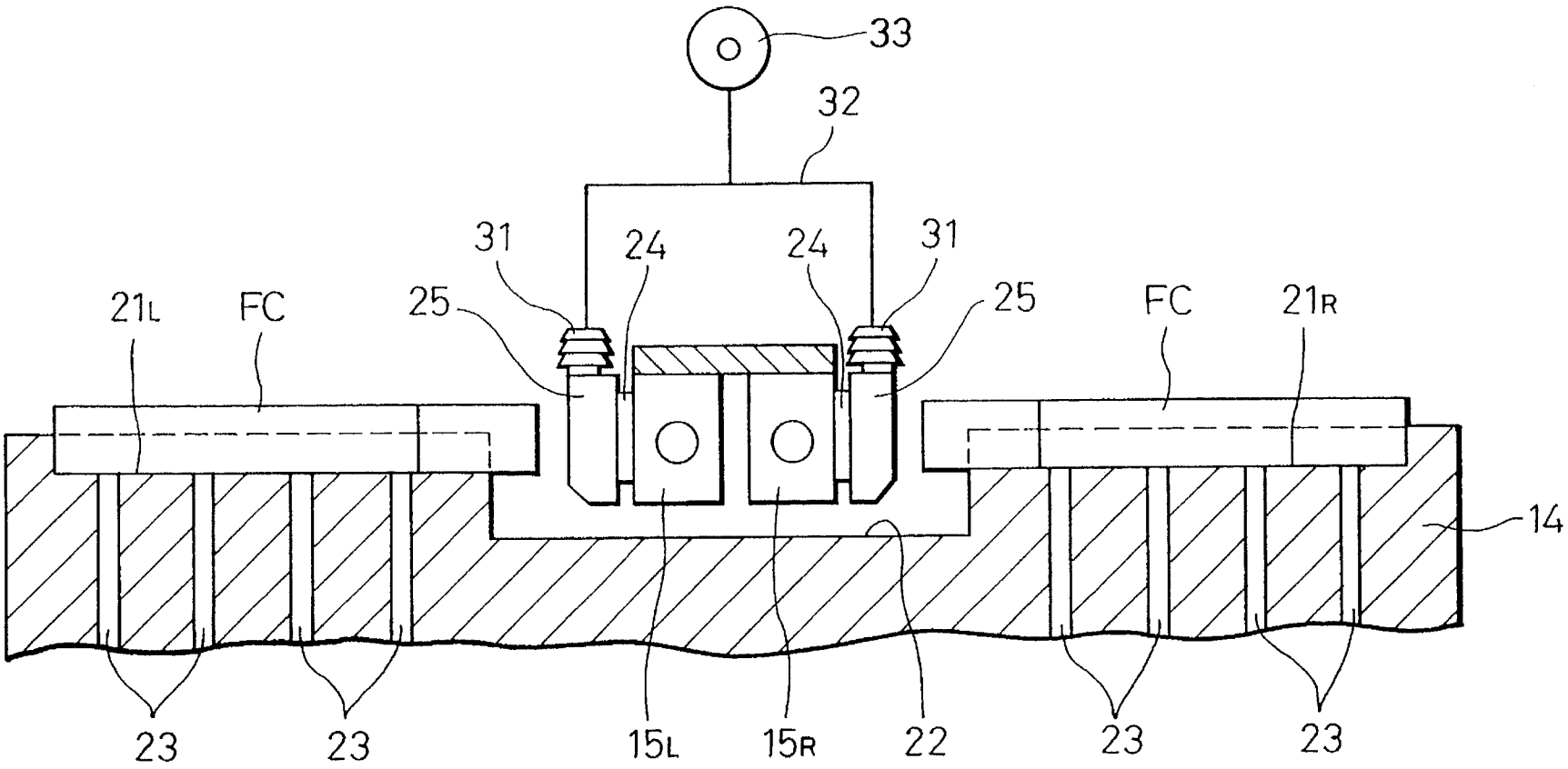
FIG. 7 is a sectional view showing a part of an inspection drum in the filter attachment.

The pair of filter cigarettes FC are then separated from each other on the drum train 4 and supplied to a drum constituting the drum train 4, that is, an inspection drum 14 (see FIG. 7). The inspection drum 14 includes a pair of optical sensors 15R and 15L see (FIG. 7), and these optical sensors 15 inspect the filter end faces (cut surface) of the filter cigarettes FC when the filter cigarettes FC pass the sensors.

The filter cigarette FC having passed the corresponding optical sensor 15 is transferred to an ejection drum 18 through an intermediate drum 17 adjacent to the inspection drum 14. The filter cigarette FC determined to be defective based on the inspection result is ejected from the ejection drum 18 while a normal filter cigarette FC is supplied to a conveyer 20 from the ejection drum 18 through a final drum 19. The above intermediate drum 17, ejection drum 18, and final drum 19 also constitute a part of the drum train 4.

FIG. 7 shows a part of the inspection drum 14 having the optical sensors 15R and 15L. The inspection drum 14 has a plurality of transfer grooves at its outer periphery and these transfer grooves are arranged at equal intervals in the circumferential direction of the inspection drum 14. Moreover, an annular groove 22 is formed on the outer periphery of the inspection drum 14 to divide the transfer grooves into the right and left transfer grooves 21R and 21L. The right and left transfer grooves 21R and 21L attract and receive filter cigarettes FC, respectively, transferred on the same axis and transfer them while the inspection drum 14 rotates. To attract filter cigarettes, the inspection drum 14 has a plurality of suction holes 23 opening at the bottom of the transfer grooves 21R and 21L as shown in FIG. 7 and these suction holes 23 can be connected to a not-illustrated negative pressure source.

The pair of optical sensors 15R and 15L are secured in the annular groove 22 of the inspection drum 14. When the inspection drum 14 rotates, filter cigarettes FC on the inspection drum 14 intermittently pass the optical sensor 15 of the corresponding side.

Each of the optical sensors 15 has an aperture ring 24 faced to a corresponding transfer groove side, through which measuring light or reflected light can be emitted in constantly or come in.

Figure 8:
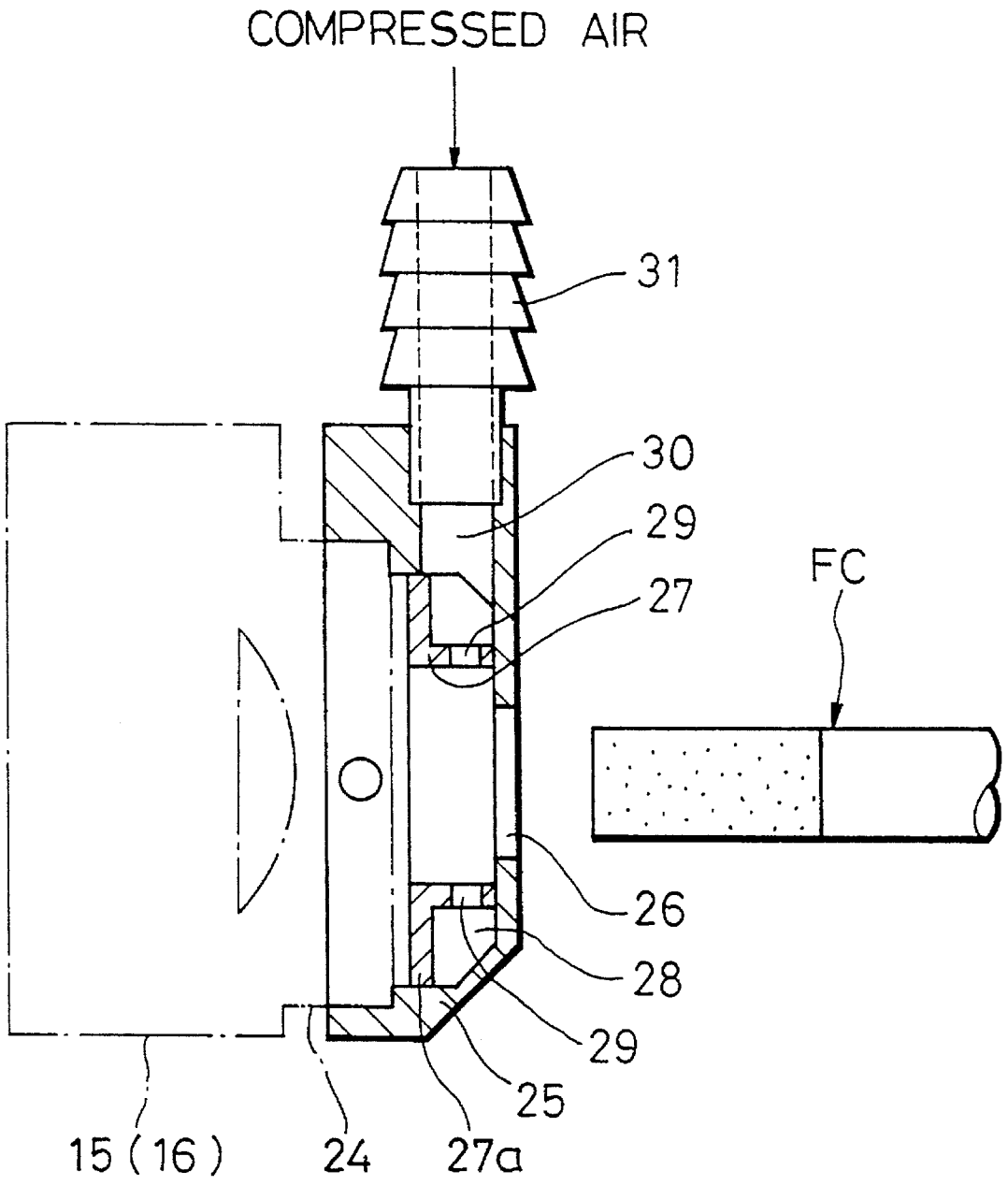
FIG. 8 is a sectional view showing a hood of an optical sensor.

The aperture ring 24 of the optical sensor 15 is covered with a hood 25 which protrudes from the aperture ring 24 so as to enclose the aperture ring 24 as shown in FIG. 8. The hood 25 has a hood mouth 26 located on the same axis as the aperture ring 24 and the hood mouth 26 is faced to the corresponding transfer groove side.

An inner ring 27 is set in the hood 25 and the inner ring 27 integrally has a flange 27*a* at one end thereof close to the aperture ring 24. The inner ring 27 is arranged on the same axis as the hood mouth 26 and has an inner diameter larger than that of the hood mouth 26. The inner periphery of the hood 27, the outer periphery of the inner ring 27, and the flange 27*a* define an annular chamber 28, and a plurality of injection holes 29 are formed in the inner ring 27 to connect the annular chamber 28 with the inside of the inner ring 27.

Further, an inlet hole 30 is formed in the hood 25 and one end of the inlet hole 30 is connected to the annular chamber 28 and the other end of the inlet hole 30 opens at the outer periphery of the hood 25. A connector 31 is inserted into the other end of the inlet hole 30 and the connector 31 is connected to a compressed-air source 33 through a hose 32 as shown in FIG. 7.

Compressed air supplied to the inlet hole 30 from the compressed-air source 33 through the hose 32 and the connector 31 flows into the annular chamber 28 of the hood 25, and is injected into the inner ring 27 from the annular chamber 28 through the injection holes 29 of the inner ring 27. The compressed air is then exhausted outside through the hood mouth 26 of the hood 25.

Figure 1:
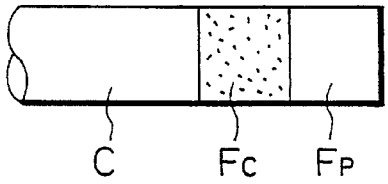
FIG. 1 is an illustration showing a normal dual filter.
Figure 2:
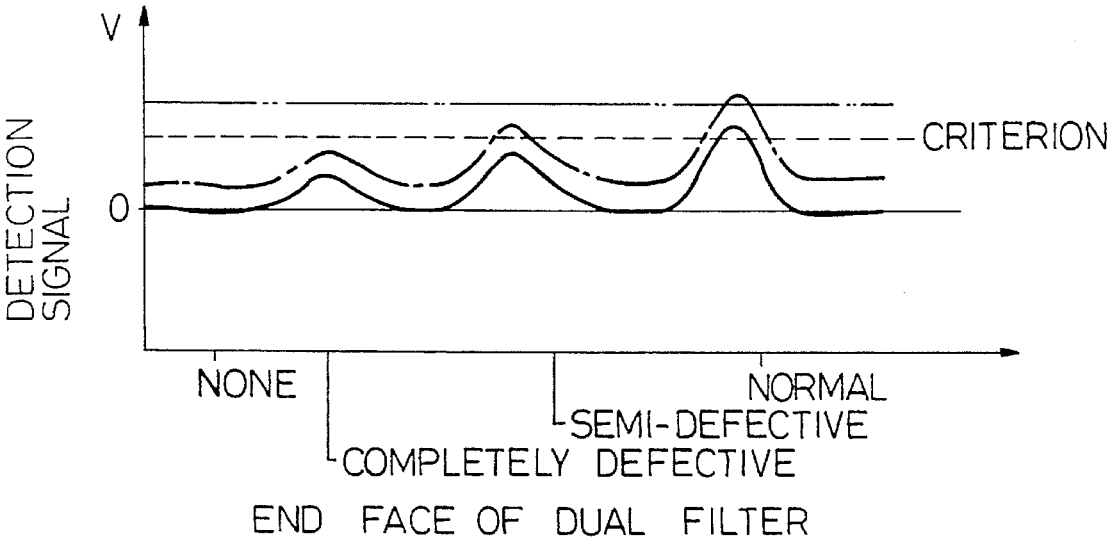
FIG. 2 is a graph showing the levels of detection signals output from an optical sensor for inspecting the filter end face of a dual filter in accordance with the state of the filter end face.
Figure 3:
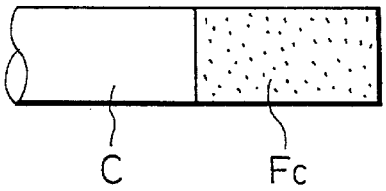
FIG. 3 is an illustration showing a completely-defective dual filter.
Figure 4:
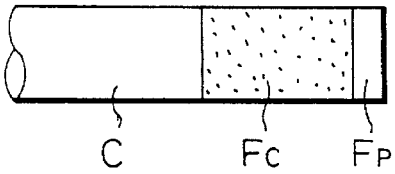
FIG. 4 is an illustration showing a semi-defective dual filter.

When a filter cigarette FC passes the front of corresponding optical sensor 15 while the inspection drum 14 rotates, the measuring light emitted from the optical sensor 15 through the aperture ring 24 and the food mouth 26 of the hood 25 is reflected at the filter end face of the filter cigarette FC. The reflected light is received by the optical sensor 15 through the hood mouth 26 of the hood 25 and the aperture ring 24, and the optical sensor 15 outputs a detection signal corresponding to the luminous energy of the received reflected light as an analog voltage signal. An actual detection signal output from the optical sensor 15 is shown as $S_0$ in FIG. 10 and the detection signal $S_0$ is an inverting signal of the detection signal shown in FIG. 2.

Figure 9:
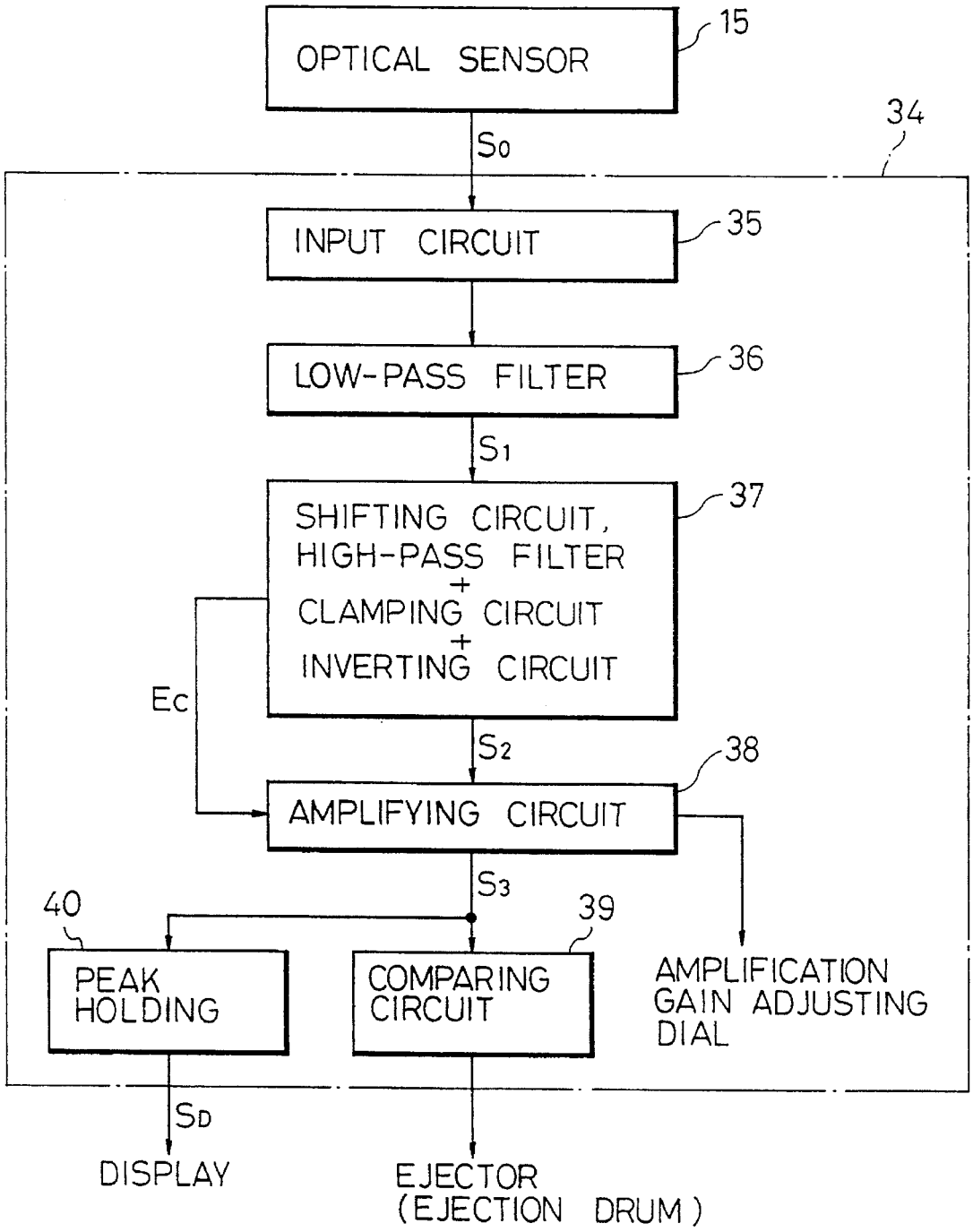
FIG. 9 is a block diagram showing a processing unit for receiving a detection signal output from the optical sensor.

The detection signal $S_0$ output from the optical sensor 15 is supplied to a processing unit 34 shown in FIG. 9. The detection signal $S_0$ is input to a low-pass filter 36 through an input circuit 35. The low-pass filter 36 removes unnecessary high-frequency noises from the detection signal $S_0$ and outputs a detection signal $S_1$ as shown by two-dot chain line in FIG. 10. The detection signal $S_1$ is supplied to a shifting circuit 37 from the low-pass filter 36. In the case of this embodiment, the shifting circuit 37 has the functions of a high-pass filter, a clamping circuit, and an inverting circuit. Therefore, unnecessary low-frequency components are first removed from the input detection signal $S_1$ by the high-pass filter of the shifting circuit 37. The base level of the detection signal $S_1$ is then clamped to a certain clamping voltage Ec by the clamping circuit and then inverted to a detection signal $S_2$ as shown by one-dot chain line in FIG. 10. The base level equals the level of the detection signal $S_1$ output from the optical sensor 15 when there is no filter cigarette to be inspected as described above.

Figure 10:
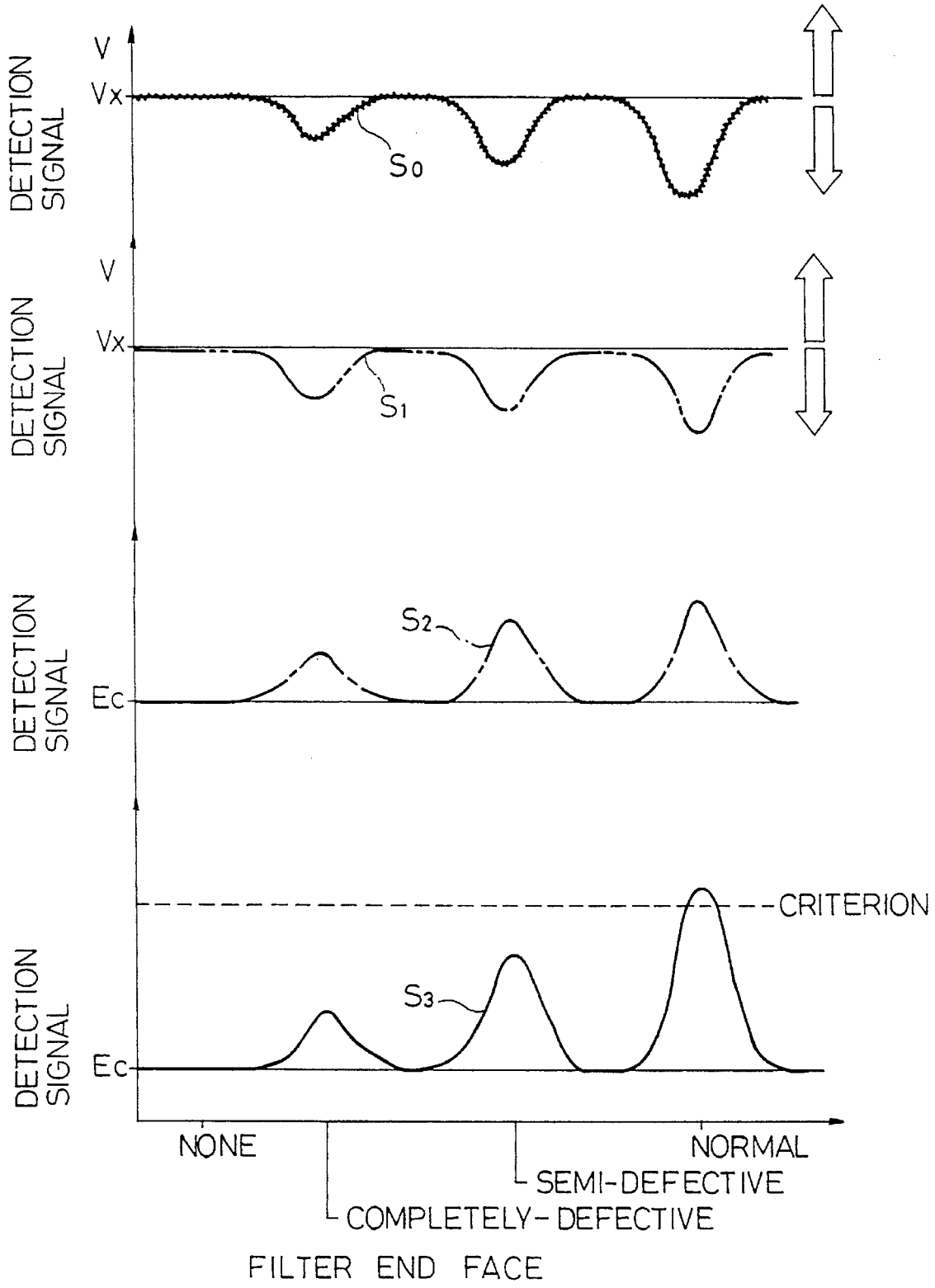
FIG. 10 is a graph showing the processing of a detection signal in the unit.

Therefore, even if the base level of the detection signal $S_1$ changes in the directions of the arrows in FIG. 10, the base level of the detection signal $S_2$ after passing the shifting circuit 37 is maintained at the clamping voltage EC as shown in FIG. 10.

Thereafter, the detection signal $S_2$ is amplified by an amplifying circuit 38 and transformed into a detection signal $S_3$ as shown by the solid line in FIG. 10. The amplifying circuit 38 maintains the base level of detection signal $S_3$ at the clamping voltage Ec. The detection signals $S_3$ is supplied to a comparing circuit 39 and a peak holding circuit 40 from the amplifying circuit 38.

The comparing circuit 39 is provided with a criterion having a level shown by the broken line in FIG. 10, and the level of the criterion is set between the level of the detection signal $S_3$ when the filter end face of a filter cigarette is normal and the level of the detection signal $S_3$ when the filter end face of the filter cigarette is semi-defective.

The comparing circuit 39 outputs a normal signal to the ejector (ejection drum) described above when the level of the received detection signal $S_3$ is equal to or higher than the criterion, whereas it outputs an abnormal signal to the ejector when the level of the detection signal $S_3$ is lower than the criterion.

When the ejector receives the abnormal signal, it ejects the filter cigarette with a defective filter end face from the ejection drum 18 by considering the transfer of filter cigarette from the inspecting position by the optical sensor 15 up to the ejecting position by the ejection drum 18.

When the peak holding circuit 40 receives the detection signal $S_3$, it holds the peak value of the detection signal $S_3$, that is, the peak value of the detection signal $S_3$ when a filter end face is normal. The peak holding circuit 40 outputs the peak value of the detection signal $S_3$ to a not-illustrated indicator such as a meter and therefore the indicator displays the peak value.

Figure 11:
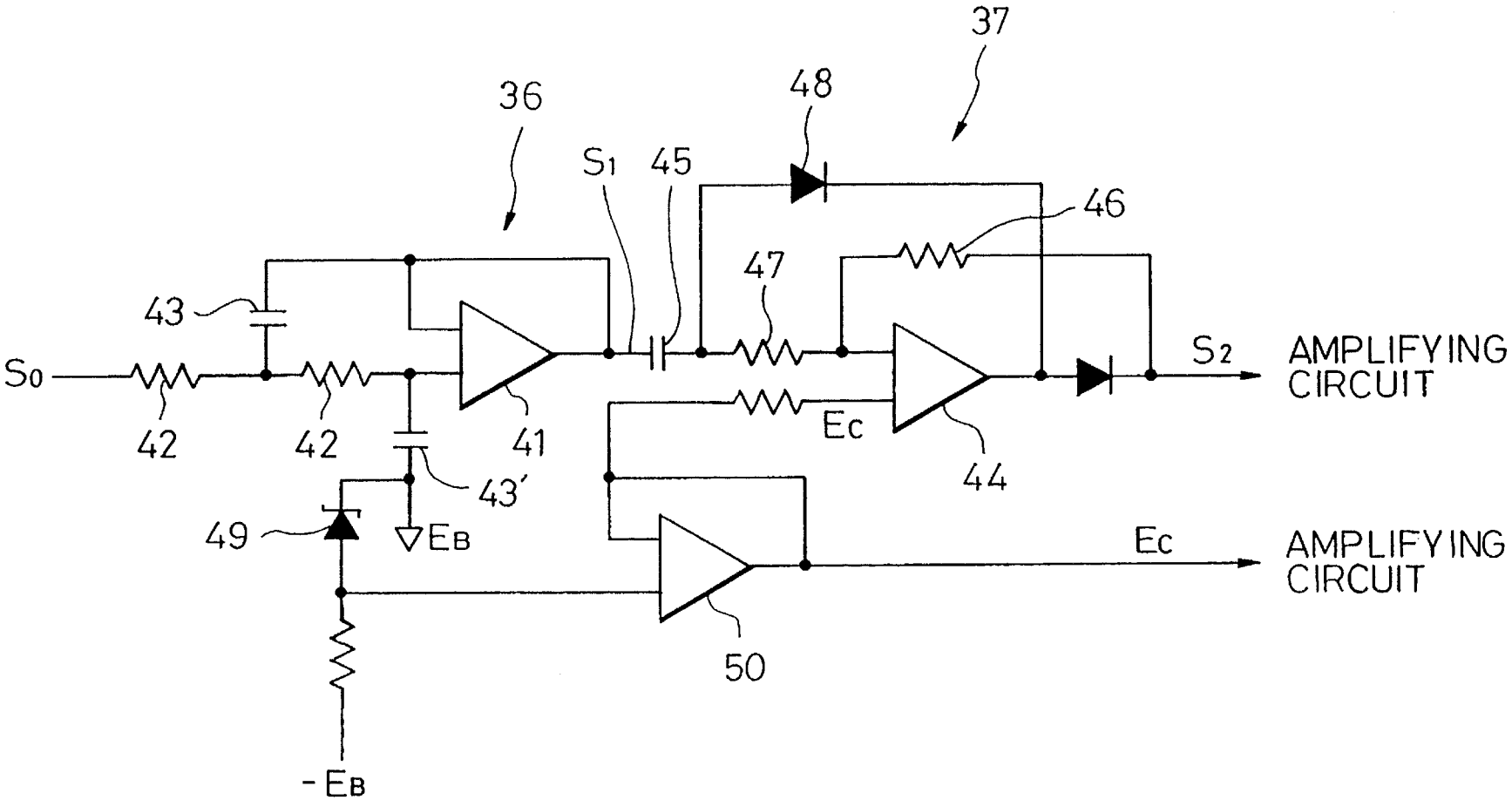
FIG. 11 is an illustration concretely showing a shifting circuit in the processing unit in FIG. 9.

The low-pass filter 36 and shifting circuit 37 shown in FIG. 9 can actually be realized in accordance with the circuit diagram in FIG. 11. As shown in FIG. 11, the low-pass filter 36 has a non-inversion amplifier 41, a resistor 42, and capacitors 43 and 43'. The high-pass filter of the shifting circuit 37 has an inverting amplifier 44, a capacitor 45, and a resistor 47 and the clamping circuit has the resistor 47 and a diode 48 bypassing the resistor 47 and the inversion amplifier 44. The circuit diagram in FIG. 11 is further provided with a Zener diode 49 and a non-inversion amplifier 50, and these devices generate a stable clamping voltage Ec from a supplied voltage $E_B$ and supply the clamping voltage Ec to the inversion amplifier 44 of the shifting circuit 37. As shown in FIG. 9, the clamping voltage Ec is also supplied to the amplifying circuit 38. The amplifying circuit 38 amplifies the detection signal $S_2$ in accordance with an amplification factor determined by an amplification gain adjusting dial on the basis of the clamping voltage Ec, and generates the detection signal $S_3$.

According to the above-described embodiment, when the filter cigarette on the inspection drum 14 passes the corresponding optical sensor 15 in accordance with the rotation of the inspection drum 14, the optical sensor 15 inspects the filter end face of the passing filter cigarette and outputs the detection signal $S_0$ to the processing unit 34. The processing unit 34 converts the received detection signal $S_0$ into the detection signal $S_3$ as described above, and then compares the detection signal $S_3$ with the criterion and ejects a defective filter cigarette from the ejection drum 18 based on the comparison result.

Because the aperture ring 24 of each optical sensor 15 is covered with the hood 25 described above and moreover compressed air is supplied into the hood 25, the compressed air is exhausted through the hood mouth 26 of the hood 25. Therefore, it is possible to greatly decrease the amount of white dust (dust of paper and filter members produced in manufacturing filter cigarettes) entering the hood 25. Incidentally, even if dust enters the hood 25, the dust is discharged from the hood 25 by the flow of the compressed air and therefore the hood 25 is always kept clean.

Thus, it is possible to decrease the deposition of the dust in the hood 25 and the luminous energy of the light reflected from the dust attached to the lens of the optical sensor 15 and thereby a detection signal output from the optical sensor 15 accurately shows the state of the filter end face to be inspected. As a result, the processing unit 34 accurately determine whether the filter end face of a filter cigarette is normal or not based on the detection signal output from the optical sensor 15 without being affected by the above dust, and abnormal filter cigarettes can securely be excluded.

In addition, as the base level of the detection signal output from the optical sensor 15 is clamped at the certain clamping voltage Ec by the shifting circuit 37, the state of filter end face is shown by the difference between the level of the detection signal $S_2$ and the clamping voltage Ec. The detection signal $S_2$ is amplified by the amplifying circuit 38 and converted into the detection signal $S_3$. Thus, the difference between the level of the detection signal $S_3$ and the clamping voltage Ec increases, thereby detecting accurately the state of filter end face in accordance with the difference.

Accordingly, even if the dust deposited in the hood 25 or moisture in the compressed air attaches to the lens of the optical sensor 15, the light reflected from the deposited dust and moisture does not affect at all the detection signal $S_2$ showing the state of filter end face, that is, the detection signal $S_3$. As a result, it is possible to accurately determine by the comparing circuit 39 whether the filter end face of a filter cigarette is normal or not in accordance with the comparison between the detection signal $S_3$and the criterion and accurately eject defective products.

Though a lamp is generally used as the source of the measuring light of the optical sensor 15, the lamp has a service life. If the lamp is broken down, the level of the detection signal $S_2$ of the shifting circuit 37 is kept at the certain clamping voltage Ec because the level of the detection signal output from the optical sensor 15 does not change at all. Therefore, abnormal signals are continuously output from the comparing circuit 39 and every filter cigarette is ejected independently of whether the filter end face of the filter cigarette is normal or not.

If the lamp of the optical sensor 15 is broken down, it is impossible to inspect the filter end face of the filter cigarette. Therefore, under such state, all the manufactured filter cigarettes are ejected, and the defective products can be prevented from being supplied to equipment installed after a filter attachment, that is, a packing machine.

The above embodiment processes the detection signal output from the optical sensor 15 with the shifting circuit 37, that is, the clamping circuit in order to prevent bad influences caused by the light reflected from portions other than the filter end face to be inspected. However, various types of circuits can be used instead of the clamping circuit. For example, it is also possible to accurately inspect the state of filter end face by detecting a change of the base level or peak level of the detection signal output from the optical sensor 15 and varying the level of a criterion in accordance with the change of the base or peak level.

Moreover, the inspection device of the present invention can also be applied to the inspection of the end face of a filter other than a triple filter or dual filter.

What is claimed is:

1. A device for detecting a defect in a charcoal filter of a manufactured filter cigarette transferred on a manufacturing line, the filter having a filter end face to be inspected, comprising:

sensing means for measuring a state of the filter end face of the filter, said sensing means including an aperture allowing a measuring light to be emitted therethrough toward the filter end face of the filter of the filter cigarette and a reflected light from the filter end face to be received therein, and outputting a detection signal corresponding to luminous energy of the received reflected light and indicative of the state of the filter end face;

a hood enclosing the aperture of said sensing means and protruding from the aperture, said hood having a hood mouth coaxially located with respect to the aperture;

blowing means for supplying compressed air into said hood and exhausting the supplied compressed air through the hood mouth; and determining means for comparing the detection signal output from said sensing means with a criterion and determining whether the filter end face of the filter is defective or not, based on the comparison result, said determining means including shifting means for shifting the detection signal output from said sensing means so as to increase a difference between a lower output level of the detection signal and the criterion by a predetermined value, wherein the shifting means has a clamping circuit for outputting a shifted detection signal produced from the detection signal by clamping the lowest output level of the detection signal at a fixed level, wherein said determining means further includes an amplifying circuit for outputting a corrected detection signal obtained by amplifying the shifted detection signal output from the clamping circuit on a basis of the fixed level, wherein said determining means further includes a comparing circuit for comparing the corrected detection signal output from the amplifying circuit with the criterion to output a comparison result, the criterion is set in accordance with the fixed level, and wherein the criterion is set at a level between a first level and an intermediate level between the first level and a second level, the first, second and intermediate levels showing that the filter end face is normal, completely defective, and intermediately defective, respectively, with intermediately defective lying between normal and completely defective.

2. The device according to claim 11, wherein the hood mouth has an inner diameter smaller than that of the aperture.

3. The device according to claim 1, wherein said blowing means includes a ring member arranged in said hood and having an inner diameter larger than that of the hood mouth and an annular chamber defined between the ring member and an inner periphery of said hood and receiving the compressed air, and a plurality of injection holes formed on the ring member to inject the compressed air from the annular chamber into the ring member.

4. The device according to claim 1, wherein said sensing means is arranged between respective pairs of filter cigarettes.

5. A device for detecting a defect in a charcoal filter of a manufactured filter cigarrete transferred on manufacturing line, the filter having a filter end face to be inspected, comprising:

sensing means for measuring a state of the filter end face of the filter, said sensing means including an aperture allowing a measuring light to be emitted therethrough toward the filter end face of the filter of the filter cigarette and a reflected light from the filter end face to be received therein, and outputting a detection signal corresponding to luminous energy of the received reflected light and indicative of the state of the filter end face;

a hood enclosing the aperture of said sensing means and protruding from the aperture, said hood having a hood mouth coaxially located with respect to the aperture;

blowing means for supplying compressed air into said hood and exhausting the supplied compressed air through the hood mouth;

determining means for comparing the detection signal output from said sensing means with a criterion and determining whether the state of the filter end face of the filter is normal, intermediately defective, or completely defective, based on the comparison result, said determining means including shifting means for shifting the detection signal output from said sensing means so as to increase a difference between a lower output level of the detection signal and the criterion by a predetermined value; and a rotating drum for transporting filter cigarettes, said drum having an annular groove therein, wherein said sensing means is arranged partially within a space defined by said annular groove.

6. The device according to claim 5, wherein said sensing means is arranged such that respective pairs of filter cigarettes simultaneously pass thereby.

7. The device according to claim 5, wherein the shifting means has a clamping circuit for outputting a shifted detection signal produced from the detection signal by clamping the lowest output level of the detection signal at a fixed level.

8. The device according to claim 7, wherein said determining means further includes an amplifying circuit for outputting a corrected detection signal obtained by amplifying the shifted detection signal output from the clamping circuit on a basis of the fixed level.

9. The device according to claim 8, wherein said determining means further includes a comparing circuit for comparing the corrected detection signal output from the amplifying circuit with the criterion to output a comparison result, the criterion is set in accordance with the fixed level.

10. The device according to claim 9, wherein the criterion is set at a level between a first level and an intermediate level between the first level and a second level, the first, second and intermediate levels showing that the filter end face is normal, completely defective, and intermediately defective, respectively, with intermediatly defective lying between normal and completely defective.

11. A device for detecting a defect in a charcoal filter of a manufactured filter cigarette transferred on a manufacturing line, the filter having a filter end face to be inspected, comprising:

sensing means for measuring a state of the filter end face of the filter, said sensing means including an aperture allowing a measuring light to be emitted therethrough toward the filter end face of the filter of the filter cigarette and a reflected light from the filter end face to be received therein, and outputting a detection signal corresponding to luminous energy of the received reflected light and indicative of the state of the filter end face;

a hood enclosing the aperture of said sensing means and protruding from the aperture said hood having a hood mouth coaxially located with respect to the aperture;

blowing means for supplying compressed air into said hood and exhausting the supplied compressed air through the hood mouth;

determining means for comparing the detection signal output from said sensing means with a criterion and determining whether the state of the filter end face of the filter is normal, intermediately defective, or completely defective, based on the comparison result, said determining means including shifting means for shifting the detection signal output from said sensing means so as to increase a difference between a lower output level of the detection signal add the criterion by a predetermined value; and a rotating drum for transporting filter cigarettes, said drum having an annular groove therein, wherein a pair of said sensing means are arranged partially within a space defined by said annular groove.

12. The device according to claim 11, wherein a first of said pair of sensing means measures a state of a filter end face of a first filter cigarette on said rotating drum, and a second of said pair of sensing means measures a state of a filter end face of a second filter cigarette on said rotating drum.

13. The device according to claim 12, wherein said first filter cigarette and said second filter cigarette are arranged on said drum in a symmetrically opposite relationship relative to said annular groove.

* * * * *